US009718522B2

(12) United States Patent
Morris et al.

(10) Patent No.: US 9,718,522 B2
(45) Date of Patent: Aug. 1, 2017

(54) ILLUMINATED WATERCRAFT TELLTALE

(71) Applicants: Rhett R. Morris, Punta Gorda, FL (US); Christopher Joseph Law, Fort Myers, FL (US)

(72) Inventors: Rhett R. Morris, Punta Gorda, FL (US); Christopher Joseph Law, Fort Myers, FL (US)

(73) Assignee: Christopher Joseph Law, Fort Meyers, FL (US)

( * ) Notice: Subject to any disclaimer, the term of this patent is extended or adjusted under 35 U.S.C. 154(b) by 58 days.

(21) Appl. No.: 14/598,537

(22) Filed: Jan. 16, 2015

(65) Prior Publication Data

US 2016/0207595 A1 Jul. 21, 2016

(51) Int. Cl.

| | |
|---|---|
| ***B63B 45/04*** | (2006.01) |
| ***B63H 20/00*** | (2006.01) |
| ***B63H 20/28*** | (2006.01) |
| ***B63H 21/38*** | (2006.01) |

(52) U.S. Cl.

CPC ..... *B63B 45/04* (2013.01); *B63H 20/28* (2013.01); *B63H 21/383* (2013.01); *B63B 2201/08* (2013.01)

(58) Field of Classification Search

CPC ..... B63B 45/04; B63B 45/02; B63B 2201/08; B63B 35/731; B63H 20/28; B63H 21/383

USPC ..... 440/76, 86; 362/96

See application file for complete search history.

(56) References Cited

U.S. PATENT DOCUMENTS

| | | | | |
|---|---|---|---|---|
| 4,699,453 | A | 10/1987 | Roberts | |
| 5,197,909 | A | 3/1993 | Rossitto | |
| 6,551,154 | B1 | 4/2003 | Jaszewski et al. | |
| 6,612,750 | B1 | 9/2003 | Bull et al. | |
| 6,971,779 | B2 | 12/2005 | Tau et al. | |
| 7,008,280 | B1 | 3/2006 | Taylor et al. | |
| 7,217,022 | B2 | 5/2007 | Ruffin | |
| 7,384,165 | B2 * | 6/2008 | Doyle | B05B 15/00 362/101 |
| 7,404,649 | B2 | 7/2008 | Gosis et al. | |
| 2009/0230028 | A1 * | 9/2009 | Mueller | G01N 21/0303 209/209 |
| 2014/0104813 | A1 | 4/2014 | Donahue | |

OTHER PUBLICATIONS

Kshatriya, 1976, Water jet as a laser light pipe, Am J Phys 44:604.

* cited by examiner

*Primary Examiner* — Karabi Guharay

(74) *Attorney, Agent, or Firm* — Brown Rudnick LLP; Thomas C. Meyers

(57) ABSTRACT

The invention provides a visibility aid for watercraft in the form a stream of water illuminated from within so that the stream of water is readily visible even in unfavorable conditions. A stream of water such as the telltale from the cooling system of an outboard motor is illuminated from within by light that exhibits total internal reflection. This makes the telltale easy to see, even at night, allowing a boat operator to know that the cooling system is functioning properly.

13 Claims, 6 Drawing Sheets

ILLUMINATED WATERCRAFT TELLTALE

FIELD OF THE INVENTION

The invention relates to illuminating a stream of water expelled from a watercraft.

BACKGROUND

Some boats are propelled by outboard motors. These motors typically have an internal combustion engine connected to a propeller. One important part of the outboard motor is the cooling system. Within the cooling system, a pump draws in water from beneath the motor and that water is circulated around the engine to draw off heat. The water is then expelled from the motor back into the body of water from which it was drawn. If the cooling system fails, the motor can overheat and fail, leaving boaters stranded out at sea, with possibly dire consequences.

To help boaters monitor the cooling system, many outboard motors provide a "telltale". The telltale is a stream of water that is visibly expelled from the motor under pressure of the water pump while the motor and the cooling system are functioning properly. Seeing the telltale assures a boater that the cooling system is protecting the motor from overheating and failing. Unfortunately, the telltale is difficult to see if conditions are not optimal. Not only is the telltale not visible at night, even during the day it can be hard to see if background conditions and lighting are unfavorable, for example, during heavy fog or a storm or at dusk.

SUMMARY

The invention provides a visibility aid for watercraft in the form a stream of water illuminated from within so that the stream of water is readily visible even in unfavorable conditions. A stream of water such as the telltale from the cooling system of an outboard motor is illuminated from within by light that exhibits total internal reflection. This makes the telltale easy to see, even at night, allowing a boat operator to know that the cooling system is functioning properly. When boating in poor-visibility conditions, if the cooling system stops working properly, the operator knows immediately and can take corrective action, avoiding overheating and destroying the motor. Since the operator can take action to avoid engine failure, the illuminated telltale helps prevent people from being stranded on the open water and also helps avoid very costly mechanical breakdowns. Additionally, an illuminated stream of water—on an outboard motor or other personal watercraft—increase the visibility of watercraft, which avoids dangerous collisions and increases safety.

In certain aspects, the invention provides a visibility device for watercraft. The device includes a multi-channel housing with an inlet channel to receive water from a propulsion system of the watercraft, a light source channel, and an exit channel. A light source is disposed in the light source channel to illuminate a stream of water as it is expelled from watercraft via the exit channel. The device may be configured to be installed on an outboard motor (e.g., as an OEM part or as a retrofit) to provide an illuminated telltale indicating an acceptable flow of water through the motor. A connector may be included for connection to a power supply such as a 12V power system of a watercraft. Preferably the light enters the water stream at an angle ≤49° to a surface of the water stream. The multi-channel housing can be made of any suitable material such as brass, an opaque polymer, etc. The light source may be provided by one or more LEDs or a laser type light.

In related aspects, the invention provides a visibility system for a watercraft. The system uses a light source to illuminate a stream of water from within as the stream of water is expelled from the watercraft during operation. The illuminated stream of water may be a telltale for a cooling system of an outboard motor, a rooster tail of a personal water craft, or any other visible stream of water. Where the stream of water is produced by a cooling system of an outboard motor of the watercraft and expelled from the outboard motor as an illuminated telltale, the visibility of the illuminated telltale shows the safe operation of the cooling system.

The outboard motor may include an internal combustion engine that has a water passage in thermal communication with the internal combustion engine, as well as an apparatus in fluid communication with the water passage. The apparatus (e.g., a multi-channel housing through which the stream of water passes) forms the stream of water and introduces light from the light source into the stream of water to provide the illuminated telltale. A multi-channel housing may include a water inlet channel configured to receive water from a propulsion system of the watercraft, a light channel in which the light source is disposed, and a water exit channel from which the stream of water exits the housing. Preferably, the light passage and the water exit passage are separated by an angle of at least 135°, for example, about 180°.

Aspects of the invention provide a method of enhancing visibility of a telltale of an outboard motor. The method includes providing a light source to a water cooling system for an outboard motor. The cooling system typically includes a water passage in thermal communication with an internal combustion engine of the outboard motor and in fluid communication with an exit conduit operable to cause a stream of water to be expelled from the outboard motor during operation. The light source is powered during operation of the motor to illuminate the stream of water from within as it is expelled from the outboard motor. Preferably, the light impinges on the stream of water at an angle such that light exhibits total internal reflection within the stream.

DETAILED DESCRIPTION

Embodiments of the invention provide a visibility device 101 for watercraft. A device 101 operates by providing a stream of water illuminated by light that exhibits total internal reflection as the stream of water is expelled from the watercraft. The device may provide an important safety and monitoring feature when deployed in the telltale of an outboard motor, although other embodiments are within the scope of the invention.

Figure 1:
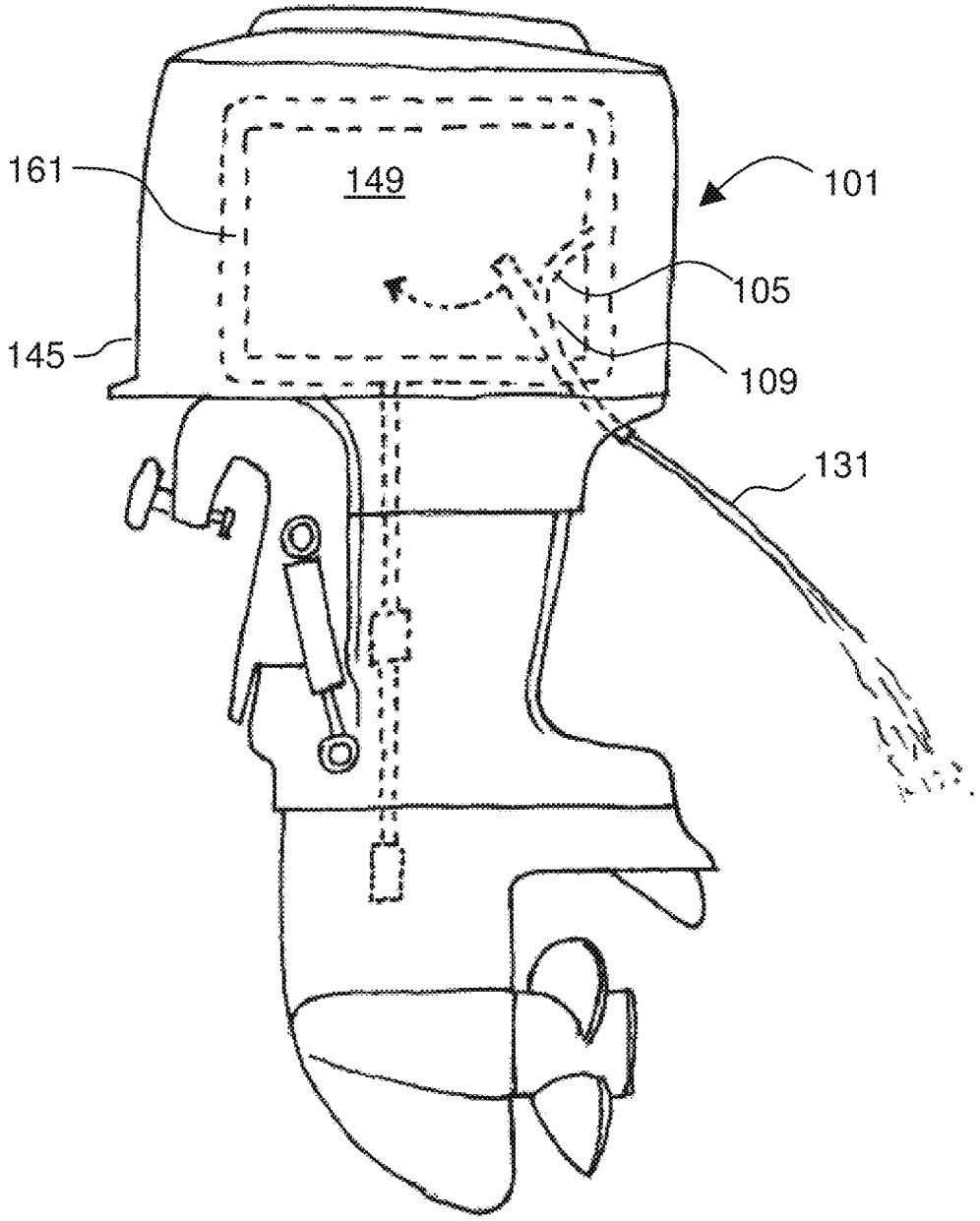
FIG. 1 shows an outboard motor with an illuminated telltale.

FIG. 1 shows an outboard motor 145 with an illuminated telltale 131. The illuminated telltale 131 is provided by device 101 installed as part of a cooling system of the outboard motor. An internal combustion engine 149 is within outboard motor 145. The cooling system includes a water passage 161 that takes water from underneath the boat (lake, river, ocean, etc.) through an inlet 135 by operation of a pump 141 and passes the water through water passage 161. Water passage 161 is in thermal communication with the internal combustion engine 149 and, as a result, the water draws heat off of the internal combustion engine 149, keeping the internal combustion engine 149 at a preferred operating temperature and avoiding issues such as oil viscosity breakdown or engine failure.

Figure 2:
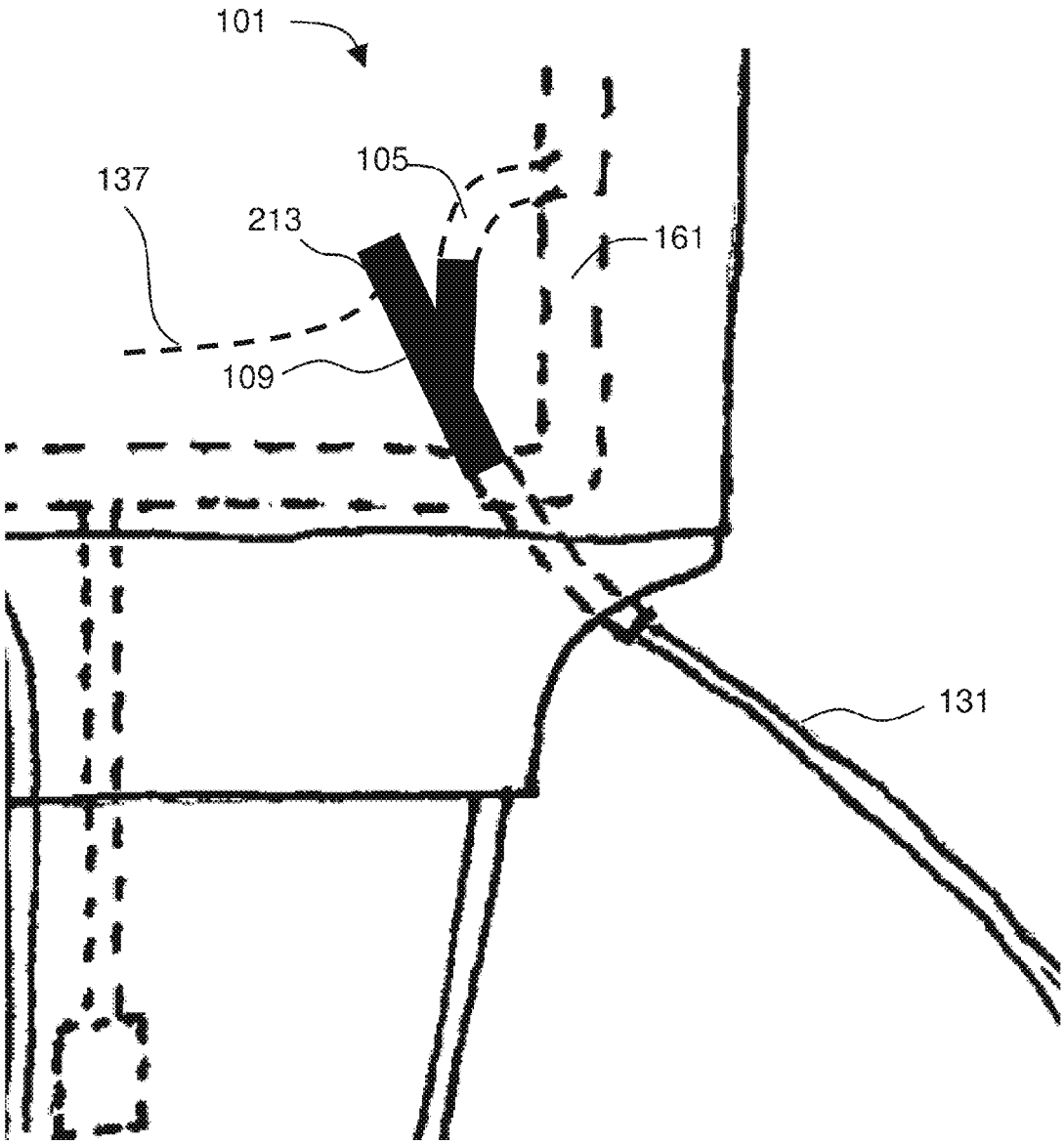
FIG. 2 gives a detailed view of the visibility device of the invention.

FIG. 2 gives a detailed view of the visibility device 101 in the outboard motor 145. Any suitable arrangement of components may be used to provide visibility device 101. In the depicted embodiment, the device 101 includes a multi-channel housing 109 in fluid communication with water passage 161. Disposed in connection with or within multi-channel housing 109 is a light source 213 and preferably connector 137 for connection to a power supply. Water that passes through the water passage 161 enters the multi-channel housing 109 under pressure as a stream of water 105. Light from light source 213 enters the stream of water 105, resulting in the outboard motor 145 expelling an illuminated telltale 131 during operation.

Figure 3:
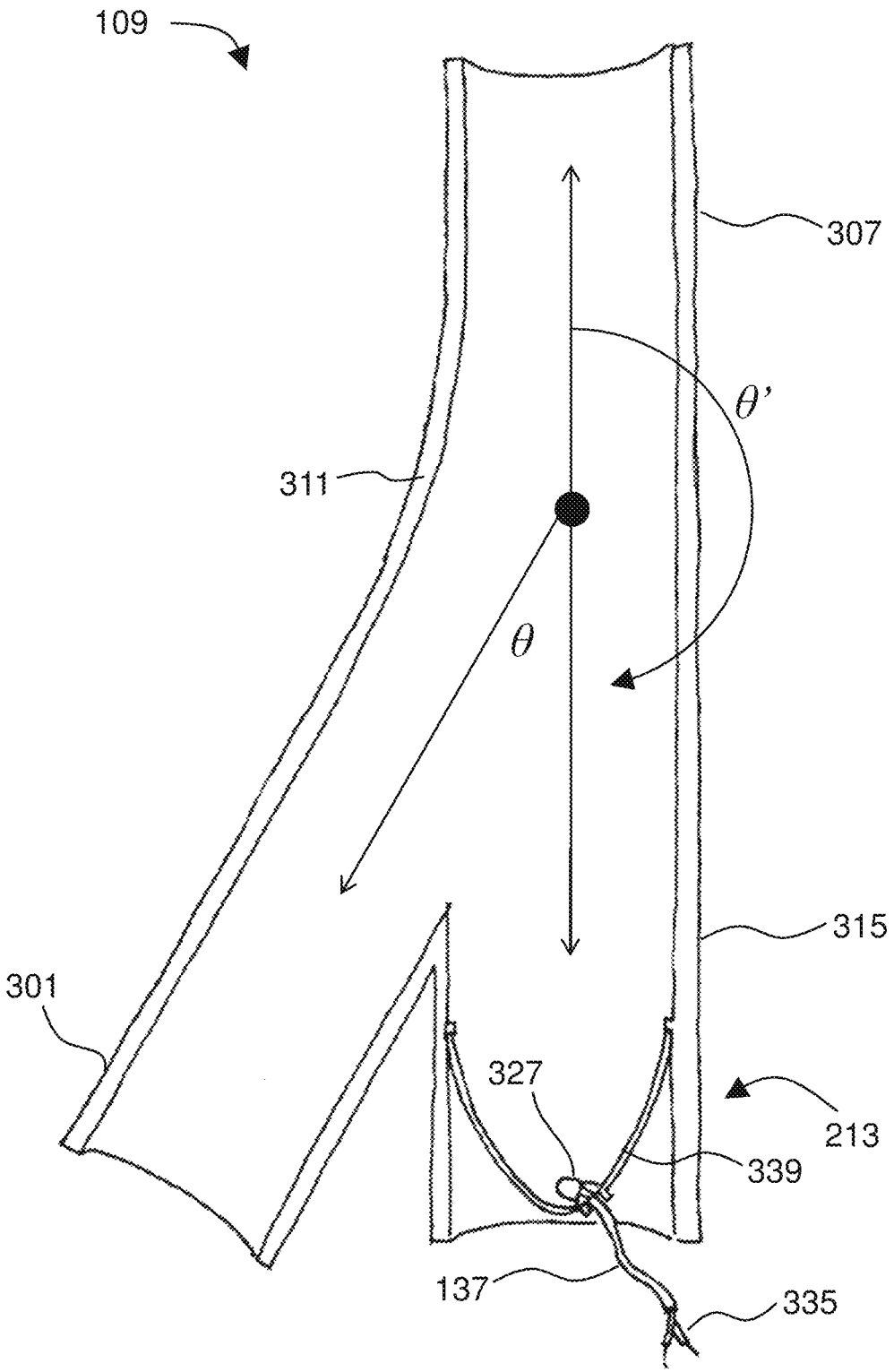
FIG. 3 is a cutaway view of a multi-channel housing.

FIG. 3 is a cutaway view of a multi-channel housing 109 according to some embodiments. Multi-channel housing 109 includes an inlet channel 301 to receive water from a propulsion system of the watercraft, a light source channel 315, and an exit channel 307. Where these channels converge, the axes of the channels converge to define a characteristic geometry of housing 109. From visual inspection of FIG. 3 it will be appreciated that the inlet channel 301 and the light source channel 315 are separated by an angle θ, here depicted to be about 30°. Also in the depicted embodiment, it can be seen that the light source channel 315 and the exit channel 307 are separated by an angle θ' which is here shown to be about 180°.

A light source 213 is disposed within the light source channel 315. Here, the light source 213 includes at least one LED 327, and the LED 327 may be connected to a power supply, such as the 12V power supply of a boat, via connectors 137 (which could include, for example, insulated wires 335). It may be desirable to include light reflectors, lenses, or collectors. For example, the light source may include the optional parabolic mirror 339 shown in FIG. 3.

The depicted geometry of housing 109 with the light source 213 disposed in the light passage allows the device to illuminate a stream of water 105 as it is expelled from watercraft via the exit channel 307. The geometry of the channels provides for total internal reflection of the light, which creates an illuminated telltale 131. The telltale 131 has light from light source 213 reflected within a stream of water. Since the light exhibits total internal reflection, the stream of water appears as a brightly illuminated stream of water. Since the telltale is a brightly illuminate stream of water it is easy to see—it can be seen at night, from a distance, or in adverse, low-contrast conditions. This can give a boat operator a continual indication that the cooling system of the outboard motor is working properly. As discussed above, the total internal reflection is provided by the geometry of device 101.

Figure 4:
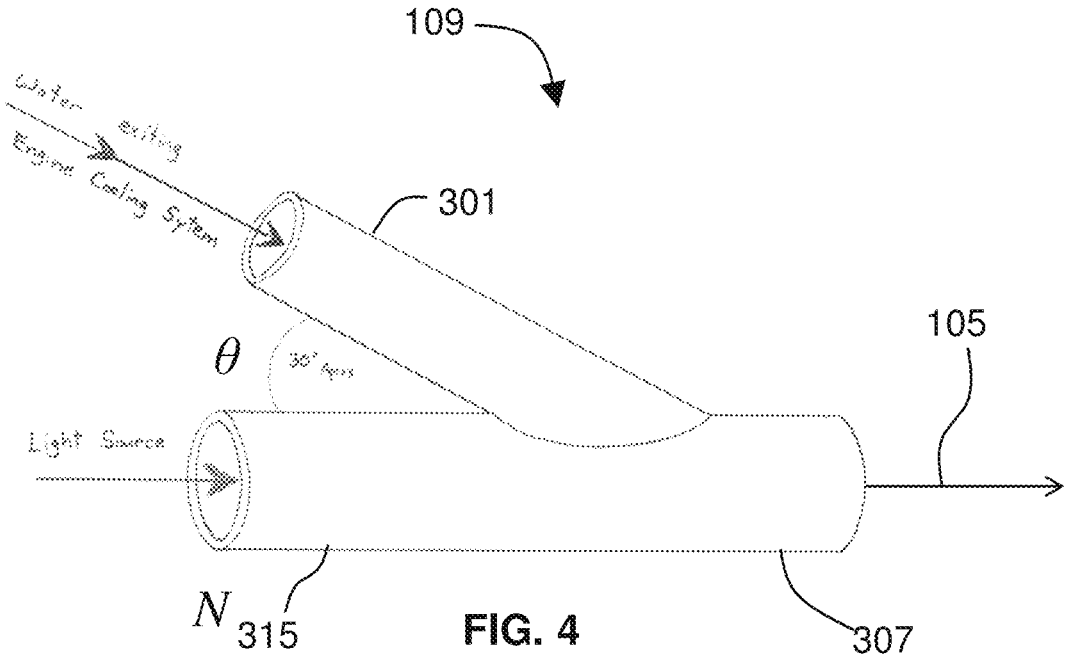
FIG. 4 diagrams the geometry of a visibility device of the invention.

FIG. 4 diagrams the geometry of a visibility device of the invention. The diagram in FIG. 4 depicts a stream of water that comes from the engine cooling system and enters the housing 109 via inlet channel 301. The light source provides light into the light source channel 315. The light impinges on a surface of the stream of water.

As described by Snell's law, the path of light is altered when it reaches a boundary between two materials, such as water and air. If the angle between the plane of the material boundary and the incoming light ray is small enough, then the light ray will be reflected off the boundary. When light is incident upon the boundary between two materials with differing indices of refraction, the light undergoes refraction in accordance with Snell's law, which states that $$(n1/n2)=(\sin \theta 2/\sin \theta 1)$$

where n1 and n2 are the indices of refraction of the first and second media respectively, θ1 is the angle the incident ray makes with the normal, and θ2 is the angle the refracted ray makes with the normal. The normal is an imaginary line, perpendicular to the boundary, that passes through the point of intersection of the incident ray and the boundary. Water has a higher index of refraction, nwater=1.333, than air, which has an index of refraction of nair=1.000293.

If light impinges upon a water surface, since the water has a higher index of refraction, the light is refracted towards the normal. At the extreme, if the path of the incident ray is perpendicular to the surface of the material boundary, the light will not refract as it is transmitted from air to water. For light that is inside the water, and encounters the material boundary at the edge of the water, since water has a higher index of refraction than air, the light will be bent away from the normal.

For light that is inside water, encountering the boundary with air at some incident angle θ1, will give a certain refracted angle θ2 according to Snell's law. Remembering that θ2 is the measure by which the refracted light deviates from the normal (the imaginary line perpendicular to the surface), it is apparent that the upper limit of θ2 is 90°. Thus the incident angle which by Snell's law gives a refracted angle of 90° is the upper limit on the incident angle above which no light will be refracted out of the water and all light will be reflected back into that water. That incident angle θ1 above which all light will be reflected back into the water is referred to as the critical angle θc. Since the refracted angle θ2 associated with the critical angle θc is known to be 90° and since the indices of refraction for both water and air are known, the critical angle can be solved via Snell's law. For light in water incident upon an air-water interface surface, the critical angle θc=sin ^−1(nair/nwater)=48.93°≈49°.

As long as the water stream does not bend at too sharp an angle, light traveling along the length of the stream strikes the water/air interface at an angle greater than 49° with respect to the normal to the interface and is thus totally reflected. See Kshatriya, 1976, Water jet as a laser light pipe, Am. J. Phys. 44:604. When describing the geometry of multi-channel housing 109 as shown in FIG. 4, it may be convenient to refer to the angle θ between the inlet channel 301 and the light source channel 315 but note that the relevant normal of Snell's law is perpendicular to the axis of light source of channel 315. Thus as long as the angle θ<(90°−49°), then the light will impinge upon the stream of water at an angle greater than the critical angle, resulting in total internal reflection of the light within the water. As shown in FIG. 4, the angle θ between the inlet channel 301 and the light source channel 315 is about 30°, thus the depicted geometry provides by total internal reflection an illuminated telltale 131.

Multi-channel housing 109 thus provides an important functionality for a visibility device 101. Such a device may be configured to be installed as a retrofit on an outboard motor 145 to provide an illuminated telltale 131 indicating an acceptable flow of water through the motor. Additionally or alternatively, device 101 may be manufactured within an outboard motor 145 in the first instance.

As depicted in FIG. 3, the light source 213 may use one or more LEDs. However, any suitable light source may be used including for example incandescent light bulbs, natural light (e.g., collected via lenses, mirrors, or both), or lasers or similar products.

Figure 5:
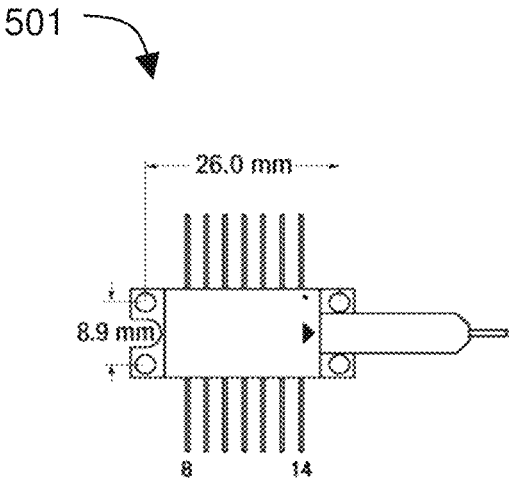
FIG. 5 depicts a laser-type light source suitable for use with the invention.

FIG. 5 depicts a laser-type light source 501 suitable for use with a device of the invention. While commonly called a laser, such a light source may in fact be a laser with a resonant cavity or may be a semiconductor optical amplifier or booster. Such laser-type light sources are available in commercial, off-the-shelf (COTS) packages and any suitable laser-type light source may be used. For example, laser-type light source 501 may include the C-Band Optical Power Booster sold under the trademark KAMELIAN by CST Global Ltd. (Glasgow, UK). A COTS light source may be connected to housing 109 by standard fiber optic cables and fittings as are known in the art. See U.S. Pat. No. 6,612,750 to Bull and U.S. Pat. No. 4,699,453 to Roberts, both incorporated by reference. Use of illumination is further discussed in U.S. Pat. No. 7,404,649 to Gosis; U.S. Pat. No. 7,217,022 to Ruffin; U.S. Pat. No. 6,971,779 to Tau; and U.S. Pub. 2014/0104813 to Donahue, each incorporated by reference. By such means, the invention provides a visibility device 101 in which a light enters the water stream at an angle $\theta \leq 42°$ to a normal N of a surface of the water stream that provides an illuminated telltale 131 for a watercraft. In a preferred embodiment, the angle $\theta$ is about 30°. Whether LED, laser, or other type, light source 213 is preferably provided with a connector 137 for connection to a power supply.

Any suitable power supply can be used to power light source 213. For example, one or more photovoltaic cells may be provided on the watercraft or on the outboard motor, which cells may charge a battery during exposure to sun. In some embodiments, a simple battery pack is used. In a preferred embodiment, the connector 137 is connectable to a power system of the watercraft, e.g., via standard insulated wires. Thus with reference back to FIG. 3 it can be seen that embodiments of the invention provide a device having a multi-channel housing 109 made with an opaque polymer 311, in which a light source 213 comprises one or more LEDs 327 or a laser-type light, and a connector 137 that includes one or more insulated wires 335.

Figure 6:
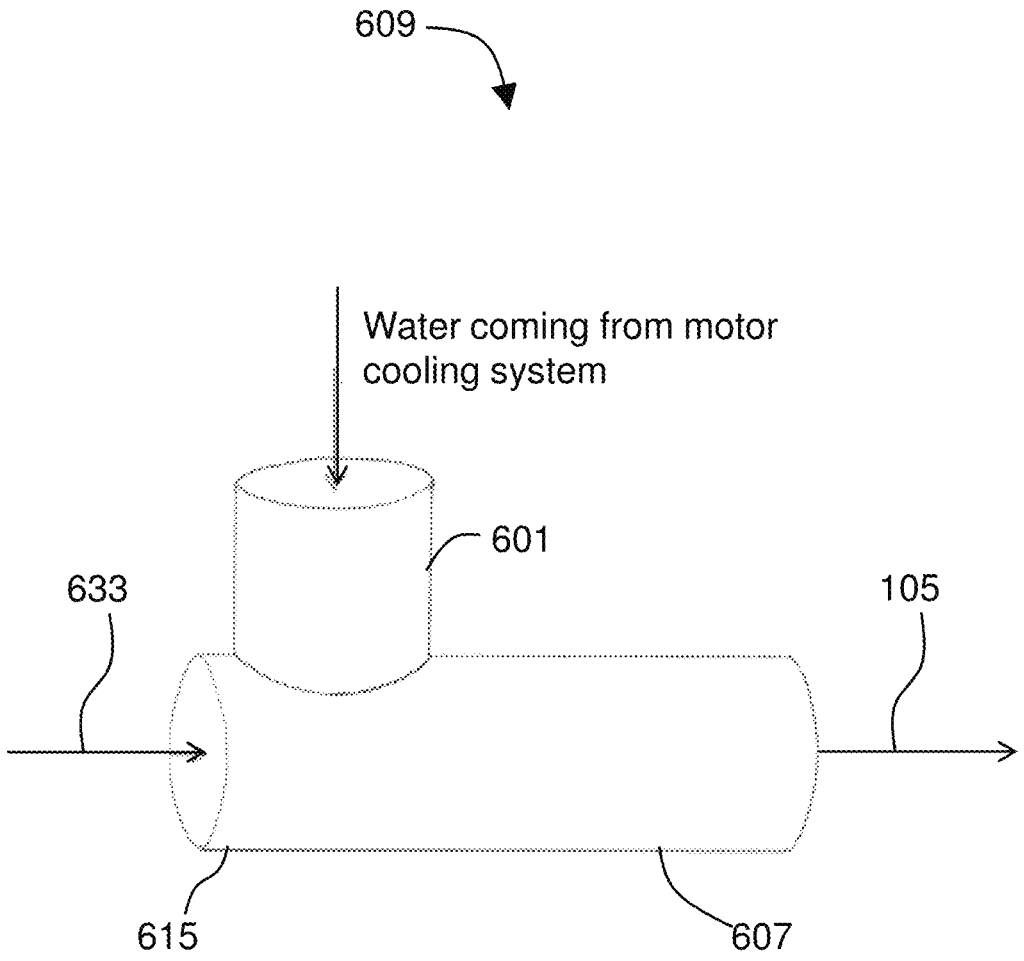
FIG. 6 shows an alternative geometry for a multi-channel housing.

FIG. 6 shows a multi-channel housing 609 according to some embodiments. Multi-channel housing 609 includes an inlet channel 301 to receive water from a propulsion system of the watercraft, a light source channel 615, and an exit channel 607. As shown, housing 609 may have a substantially 90° geometry. From visual inspection of FIG. 6 it will be appreciated that the inlet channel 601 and the light source channel 615 are separated by an angle $\theta$, here depicted to be about 90°. Also in the depicted embodiment, it can be seen that the light source channel 615 and the exit channel 607 are separated by an angle $\theta'$ which is here shown to be about 180°.

A light source is disposed within or proximal the light source channel 615. The light source may include one or more LED, laser, or standard light bulb and may be connected to a power supply, such as the 12V power supply of a boat. It may be desirable to include light reflectors, lenses, or collectors.

The depicted geometry of housing 609 with incoming light 633 entering through the light channel 615 allows the device to illuminate a stream of water 105 as it is expelled from watercraft via the exit channel 607. The geometry of the channels provides for total internal reflection of the light, which creates an illuminated telltale 131. The telltale 131 has light reflected within a stream of water. Since the light exhibits total internal reflection, the stream of water appears as a brightly illuminated stream of water. Since the telltale is a brightly illuminate stream of water it is easy to see—it can be seen at night, from a distance, or in adverse, low-contrast conditions, giving a continual indication that the cooling system of the outboard motor is working properly.

Some variation in the geometry depicted for housing 609 is permissible. As discussed above, light that strikes the water/air interface at an angle greater than 49° with respect to the normal to the interface and is thus totally reflected. See Kshatriya, 1976, Water jet as a laser light pipe, Am. J. Phys. 44:604. With respect to the geometry of multi-channel housing 609 as shown in FIG. 6, it may be preferable that an angle between incoming light 633 and stream of water 105 approach 180° and be at least greater than 130°.

The depicted multi-channel housing 609 thus provides an important functionality for a visibility device 101. Such a device may be configured to be installed as a retrofit on an outboard motor 145 to provide an illuminated telltale 131 indicating an acceptable flow of water through the motor. Additionally or alternatively, device 101 may be manufactured within an outboard motor 145 in the first instance.

Systems and methods of the invention provide a visibility system for a watercraft in which a light source 213 is operable to illuminate a stream of water 105 from within as the stream of water 105 is expelled from the watercraft during operation.

In the foregoing examples and as shown in FIGS. 1 & 2, embodiments of the invention provide that a stream of water produced by a cooling system of an outboard motor 145 of a watercraft is expelled from the outboard motor 145 as an illuminated telltale 131 showing operation of the cooling system. The outboard motor may include an internal combustion engine 149 with a water passage 161 in thermal communication with the internal combustion engine 149. The apparatus 109 in fluid communication with the water passage 161 forms the stream of water and introduces light from the light source into the stream of water 108 to provide the illuminated telltale. While other arrangements and form-factors are within the scope of the invention, in the depicted embodiments, the light source 213 is disposed within a multi-channel housing 109 through which the stream of water 105 passes. The multi-channel housing has a water inlet channel 301 configured to receive water from a propulsion system of the watercraft; a light channel 315 in which the light source is disposed; and a water exit channel 307 from which the stream of water exits the housing.

Similarly, the invention provides methods for enhancing the visibility of a watercraft or a feature of a watercraft such as the telltale of an outboard motor. In certain embodiments, methods of the invention include providing a light source to a cooling system for an outboard motor. The cooling system includes a water passage in thermal communication with an internal combustion engine of the outboard motor and in fluid communication with an exit conduit operable to cause a stream of water to be expelled from the outboard motor during operation thereof. The light source is powered during operation of the motor to illuminate the stream of water from within as it is expelled from the outboard motor. The light impinges on the stream of water at an angle such that light exhibits total internal reflection within the stream. In some embodiments, the watercraft is a personal water craft such as the personal watercraft sold under the trademark WAVERUNNER by Yamaha Motor Company (Shizuoka, Japan).

Figure 7:
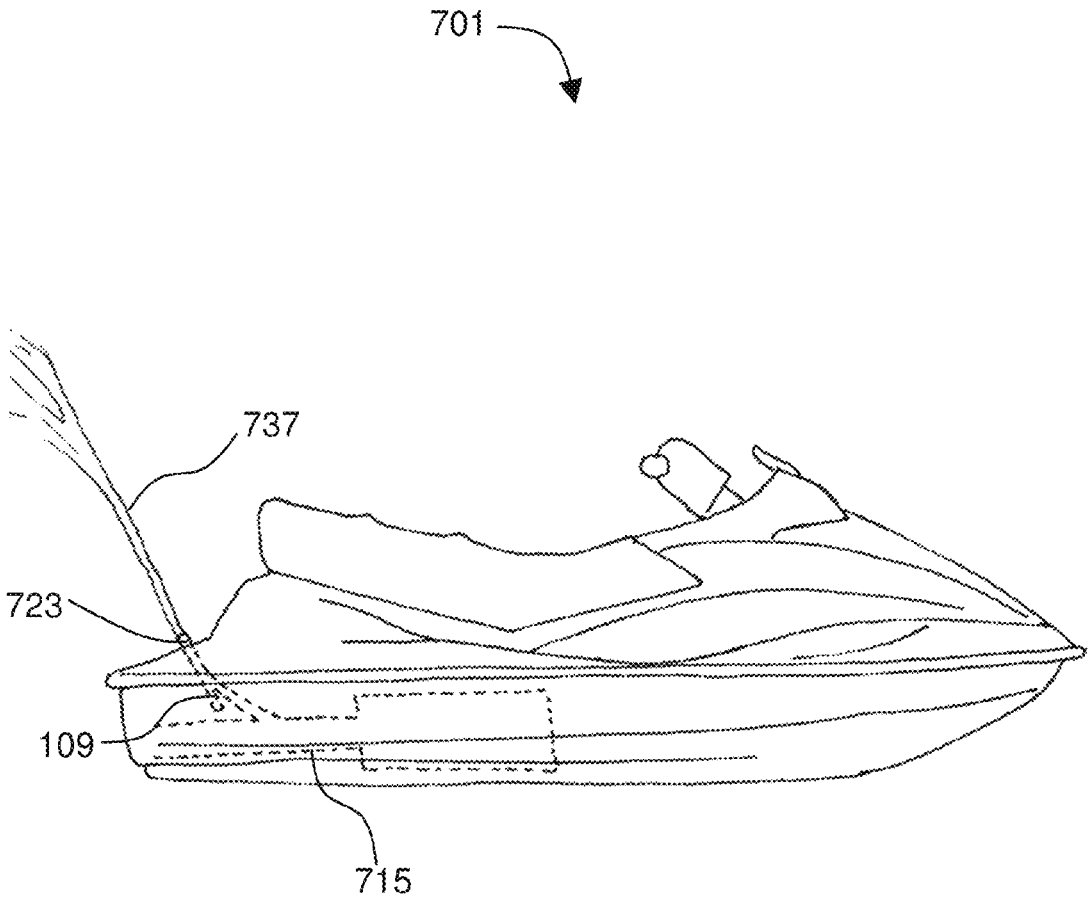
FIG. 7 shows a personal watercraft with an illuminated visibility device.

FIG. 7 shows a personal watercraft 701 with an illuminated visibility device according to embodiments of the invention. Watercraft 701 includes a propulsion system 715. In some embodiments, propulsion system 715 operates on the principle of one or more impellers creating a jet of water expelled aft of the craft to propel the craft forward. A small portion of the water from the jet is shunted to an expulsion nozzle 723. Due to the water pressure from the propulsion system 715, during operation of the craft 701, the shunted water forms a tall rooster tail 737 that enhances the visibility, and thus safety, of craft 701. The shunt diverting water towards nozzle 723 includes a multi-channel housing 109 that includes a light source 213 as described above in connection with FIG. 3. Due to the light impinging on the water of rooster tail 737 at the critical angle, rooster tail 737 is illuminated by light that exhibits total internal reflection. Since rooster tail 737 is brightly illuminated from within, watercraft 701 is visible from a distance, at night, or in adverse visibility conditions. This visibility aid helps prevent dangerous collisions and provides for safer boating.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

What is claimed is:

1. A visibility device for watercraft, the device comprising:

a multi-channel housing comprising:

an inlet channel to receive water from a propulsion system of the watercraft, a light source channel, and an exit channel; and a light source disposed in the light channel and configured to illuminate a stream of water as it is expelled from watercraft via the exit channel, wherein the light source channel and the inlet channel converge with one another at an angle θ of less than 45° to thereby result in the light impinging on the stream of water at an angle sufficient to cause the light to exhibit total internal reflection within the stream.

2. The device of claim 1, wherein the device is configured to be installed on an outboard motor to provide an illuminated telltale indicating an acceptable flow of water through the motor.

3. The device of claim 1, wherein the light enters the water stream at an angle ≤49° to a normal of a surface of the water stream.

4. The device of claim 1, further comprising a connector for connection to a power supply.

5. The device of claim 4, wherein the multi-channel housing comprises an opaque polymer, the light source comprises one or more LEDs, and the connector comprises one or more insulated wires.

6. A visibility system for a watercraft, the system comprising:

a light source operable to illuminate a stream of water from within as the stream of water is expelled from the watercraft during operation, the light source is disposed within a multi-channel housing through which the stream of water passes, wherein the multi-channel housing comprises:

a water inlet channel configured to receive water from a propulsion system of the watercraft;

a light channel in which the light source is disposed, wherein the light channel and the water inlet channel converge with one another at an angle θ of less than 45° to thereby result in the light impinging on the stream of water at an angle sufficient to cause the light to exhibit total internal reflection within the stream; and a water exit channel from which the stream of water exits the housing.

7. The system of claim 6, wherein the stream of water is produced by a cooling system of an outboard motor of the watercraft and the stream of water is expelled from the outboard motor as an illuminated telltale showing operation of the cooling system.

8. The system of claim 7, wherein the outboard motor comprises:

an internal combustion engine;

a water passage in thermal communication with the internal combustion engine; and an apparatus in fluid communication with the water passage configured to form the stream of water and introduce light from the light source into the stream of water to provide the illuminated telltale.

9. The system of claim 6, further comprising electrical connectors for connecting the light source to a 12V electrical supply of the watercraft.

10. The system of claim 6, wherein the light channel and the water exit channel are separated by an angle $\theta_2$ and $\theta_2 \geq 135°$ .

11. The system of claim 10, wherein $\theta_2$ is about 180° .

12. The system of claim 6, wherein the multi-channel housing comprises an opaque polymer.

13. The system of claim 6, wherein the stream of water is generated by a propulsion system of a personal watercraft.

* * * * *